US009488356B2

(12) United States Patent
Gui et al.

(10) Patent No.: US 9,488,356 B2
(45) Date of Patent: Nov. 8, 2016

(54) ILLUMINATING DEVICE AND MANUFACTURING METHOD THEREOF

(71) Applicant: OSRAM GmbH, Munich (DE)

(72) Inventors: Hui Gui, Guangdong (CN); Xiaoyu Chen, Guangdong (CN); Junhua Zeng, Guangdong (CN); Jin Hu, Guangdong (CN)

(73) Assignee: OSRAM GmbH, Munich (DE)

( * ) Notice: Subject to any disclaimer, the term of this patent is extended or adjusted under 35 U.S.C. 154(b) by 122 days.

(21) Appl. No.: 14/371,439

(22) PCT Filed: Jan. 3, 2013

(86) PCT No.: PCT/EP2013/050061

§ 371 (c)(1),
(2) Date: Jul. 10, 2014

(87) PCT Pub. No.: WO2013/104555

PCT Pub. Date: Jul. 18, 2013

(65) Prior Publication Data

US 2015/0003071 A1 Jan. 1, 2015

(30) Foreign Application Priority Data

Jan. 10, 2012 (CN) ..... 2012 1 0006346

(51) Int. Cl.
*F21V 23/06* (2006.01)
*F21V 19/00* (2006.01)
(Continued)

(52) U.S. Cl.
CPC ..... *F21V 23/06* (2013.01); *F21K 9/30* (2013.01); *F21K 9/90* (2013.01); *F21V 7/04* (2013.01);
(Continued)

(58) Field of Classification Search
CPC ..... F21V 29/00; F21V 29/70; F21V 29/80; F21V 7/04; F21V 23/06; F21V 29/87; F21V 19/005; F21K 9/30; F21K 9/90
See application file for complete search history.

(56) References Cited

U.S. PATENT DOCUMENTS

2005/0180157 A1 8/2005 Watanabe et al.
2006/0227558 A1* 10/2006 Osawa ..... F21K 9/135 362/351

(Continued)

FOREIGN PATENT DOCUMENTS

CN 1644978 A 7/2005
CN 101675289 A 3/2010

(Continued)

OTHER PUBLICATIONS

Chinese Office Action based on Application No. 201210006346.3 (8 Pages and 7 Pages of English translation) dated Oct. 27, 2015.

(Continued)

*Primary Examiner* — Anh Mai
*Assistant Examiner* — Nathaniel Lee

(57) ABSTRACT

Various embodiments relate to an illuminating device may include a circuit board carrying a light-emitting element, a driver and a heat sink arranged between the circuit board and the driver, wherein the heat sink has a non-conductive base and at least one pair of conductive connectors which embedded in the non-conductive base, respective connector having a first end extending from one side of the non-conductive base to hold the circuit board and a second end extending from the other side of the non-conductive base to hold the driver, wherein the circuit board and the driver are electrically connected by means of the connectors. Various embodiments further relate to a method for manufacturing the illuminating device.

15 Claims, 4 Drawing Sheets

(51) Int. Cl.

| | |
|---|---|
| ***F21V 7/04*** | (2006.01) |
| ***F21V 29/87*** | (2015.01) |
| *F21V 29/70* | (2015.01) |
| *F21K 99/00* | (2016.01) |
| *F21Y 101/02* | (2006.01) |
| *F21V 23/00* | (2015.01) |
| *F21V 29/505* | (2015.01) |
| *F21V 29/77* | (2015.01) |

(52) U.S. Cl.
CPC ..... *F21V 19/005* (2013.01); *F21V 29/87* (2015.01); *F21K 9/1375* (2013.01); *F21V 23/003* (2013.01); *F21V 29/505* (2015.01); *F21V 29/773* (2015.01); *F21Y 2101/02* (2013.01); *Y10T 29/4913* (2015.01)

(56) References Cited

U.S. PATENT DOCUMENTS

| | | | | |
|---|---|---|---|---|
| 2011/0095690 | A1* | 4/2011 | Sagal | B29C 45/14 315/113 |
| 2011/0175529 | A1* | 7/2011 | Hayashi | F21S 48/1104 315/77 |
| 2012/0025708 | A1 | 2/2012 | Choi et al. | |
| 2012/0147608 | A1 | 6/2012 | Kawagoe et al. | |
| 2013/0288514 | A1 | 10/2013 | Sekine et al. | |

FOREIGN PATENT DOCUMENTS

| | | | |
|---|---|---|---|
| CN | 102182971 | A | 9/2011 |
| DE | 4310440 | A1 | 2/1994 |
| JP | 4838902 | B1 | 12/2011 |
| KR | 101028339 | B1 | 4/2011 |
| WO | 2008133889 | A1 | 11/2008 |
| WO | 2011105049 | A1 | 9/2011 |

OTHER PUBLICATIONS

International Search Report of PCT/EP2013/050061 mailed on Mar. 19, 2013.

* cited by examiner

ILLUMINATING DEVICE AND MANUFACTURING METHOD THEREOF

RELATED APPLICATIONS

The present application is a national stage entry according to 35 U.S.C. §371 of PCT application No.: PCT/EP2013/05061 filed on Jan. 3, 2013, which claims priority from Chinese application No.: 201210006346.3 filed on Jan. 10, 2012, and is incorporated herein by reference in its entirety.

TECHNICAL FIELD

Various embodiments relate to an illuminating device and a method for manufacturing the illuminating device.

BACKGROUND

At present, illuminating devices are widely used in day life. As the structure and performances of the illuminating device should be optimized and improved persistently, requirements of high standards are put forward on, for instance, the connecting manner between components in the illuminating device.

Within an illuminating device, a reliable electrical connection between a circuit board and a driver should be assured to allow the illuminating device to normally operate. In the related art, the circuit board and the driver are usually electrically connected via a wire with a soldering method, that is to say, both ends of the wire are soldered on solder joints of the circuit board and the driver, respectively.

Such connecting manner demands a lot of efforts and materials. In addition, during the soldering process, light-emitting devices such as LED might be damaged. Another connecting possibility is that the circuit board and the driver are electrically connected by means of an additional connector, while the drawback lies in that, apart from extra cost of the connector, the connector still needs to be fixed on the circuit board by using, for example, a solder paste.

Besides, mechanical connection between components of the illuminating device usually needs to be realized by means of additional mechanical connectors such as bolts. But such connectors, most of which are made from metal, will easily cause the short circuit of the circuit board, and also increase the manufacturing cost of the illuminating device.

SUMMARY

In order to solve the above problems, various embodiments provide a novel illuminating device. The illuminating device of the present disclosure can simultaneously realize, by means of a heat sink, the mechanical connection and the electrical connection between the circuit board and the driver, without additional connector, has a strong universality and a simple structure, and is easily installed. In addition, various embodiments further provide a method for manufacturing the illuminating device.

An illuminating device, including a circuit board carrying a light-emitting element, a driver and a heat sink arranged between the circuit board and the driver, characterized in that the heat sink has a non-conductive base and at least one pair of conductive connectors which embedded in the non-conductive base, respective connector has a first end extending from one side of the non-conductive base to hold the circuit board and a second end extending from the other side of the non-conductive base to hold the driver, wherein the circuit board and the driver are electrically connected by means of the connectors.

In various embodiments, at least one pair of conductive convectors, as positive pin and negative pin, are directly embedded in the non-conductive base of the heat sink, and the connector serves double functions of mechanical connection and electrical connection. Such heat sink integrated with the connectors can be fixed together with the circuit board by means of the first ends thereof and fixed together with the driver by means of the second ends thereof; meanwhile, the circuit board and the driver located at both side of the non-conductive base are also electrically connected with each other. In the illuminating device of the present disclosure, there is no need to provide extra electrical connectors or mechanical connectors, thus, the manufacturing process is simplified, and the number of parts of the illuminating device is also minimized.

In various embodiments, the connectors are formed in the non-conductive base through an insert-molding process. As a result, the connectors can be firmly connected together with the heat sink, in a mode of insertion, to form a multi-functional part in one piece.

In various embodiments, respective connector has a tubular body and at least one bending portion as the first end that bends radially outwardly from the tubular body. The heat sink can be formed through injection molding around the tubular bodies of the connectors, and respective first end extending beyond one side of the non-conductive base bends radially outwardly for the purpose of, for instance, forming a turned edge. By means of the bending portion, the circuit board can be fixed on the heat sink in a manner of, for instance, pressing. Of course, the body of respective connector also can be designed to have other shapes such as belt shape or strip shape having an elongated extending tendency.

Preferably, the non-conductive base further has protective flanges each formed at a joint between the tubular body and the first end and surrounding the tubular body. The protective flanges are formed on the heat sink and enclose respective tubular bodies in a circumferential direction to prevent the tubular body from directly contacting the circuit board and avoid a short circuit caused thereby.

In various embodiments, the circuit board has via holes corresponding to respective first ends and conduction regions surrounding respective via holes, and the first end passes through the via hole to press against the conduction region and electrically contact the conduction region. The conduction region is adjacent to respective via hole in a radial direction so that the first end passing through the via hole directly presses against the conduction region; meanwhile, the mechanical connection and the electrical connection between the connector and the circuit board are realized.

In various embodiments, the second end of respective connector is tubular, and the driver includes accommodating portions for accommodating respective second ends. At the other side of the heat sink away from the circuit board, the connectors are inserted into respective accommodating portions of the driver by means of respective second ends, thus, the connectors also mechanically fix the driver at the other side of the heat sink and meanwhile is electrically connected with the driver.

In various embodiments, the heat sink further includes a non-conductive circumferential wall which defines a cavity together with the non-conductive base for accommodating the circuit board. By providing the circumferential wall, the circuit board can be protected. Particularly, an inner surface of the circumferential wall is designed to be a reflective surface. The heat sink configured in such a manner can exist in a form of a reflective cup so that the luminous efficiency of the illuminating device is improved.

In various embodiments, a plurality of cooling ribs are formed on an outer surface of the circumferential wall. The heat dissipating area of the illuminating device can be increased through the plurality of cooling ribs, which is favorable for elongate the service lifetime of the illuminating device.

In various embodiments, the connectors are made from metal. The connector can be made from, for instance, copper or other materials having a good electrical conductivity. Therefore, it can be assured that the circuit board and the driver are reliably electrically connected.

In various embodiments, the heat sink is made from plastic. The heat sink can be selected to be made from plastics that have good thermal conductivity, and therefore, it will be assured that a short circuit will not occur between the heat sink and the other electronic devices.

Various embodiments further relate to a method for manufacturing the illuminating device, including steps of:

a) providing at least one pair of connectors, injecting a non-conductive material around the connectors in one piece through an insert-injection technology to form a non-conductive base of a heat sink, with a first end of respective connector extending from one side of non-conductive base, and with a second end of respective connector extending from the other side of the non-conductive base;

b) providing a circuit board for carrying a light-emitting element, holding the circuit board on the one side of the non-conductive base by means of the first ends, and electrically connecting the first ends and the circuit board; and c) providing a driver, fixing the driver on the other side of the non-conductive base by means of the second ends, and electrically connecting the second ends with the driver.

The at least one pair of connectors and the heat sink are integrated in one piece through the insert-injection technology, and the circuit board and the driver can be simply fixed on both sides of the non-conductive base of the heat sink, respectively, by using the heat sink, so as to form a complete illuminating device; moreover, the circuit board and the driver can be electrically connected through the connectors, wherein the order of step b) and step c) can be exchanged.

In various embodiments, in step a), respective connector includes a tubular body, the first end bending radially outwardly from the tubular body and the second end that is tubular.

In various embodiments, in step b), the circuit board has via holes corresponding to respective first ends and conduction regions surrounding respective via hole, and the first end passes through the via hole to press against the conduction region and electrically contact the conduction region. As a result, the connector is mechanically and electrically connected to the circuit board through the first ends.

In various embodiments, in step c), the driver includes accommodating portions for accommodating respective second ends. Therefore, the connected is mechanically and electrically connected to the driver through the second ends.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
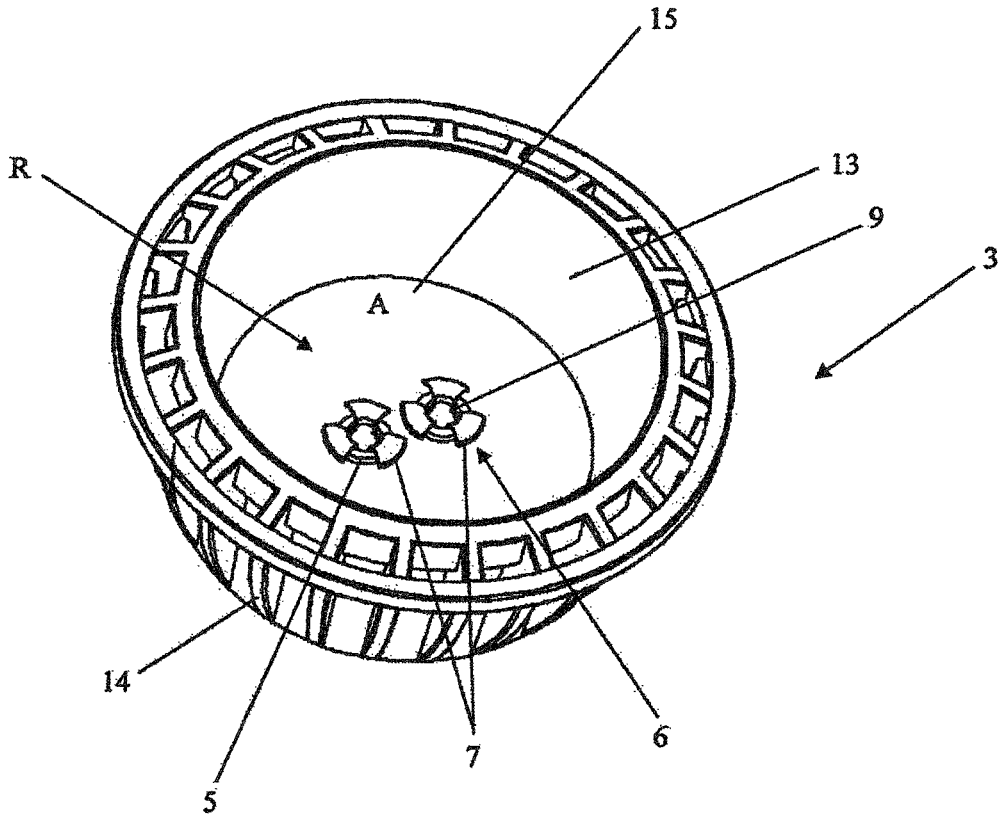
FIG. 1 is a 3D top view of a heat sink of an illuminating device of the present disclosure.

FIG. 1 shows a heat sink of an illuminating device of the present disclosure. As can be seen from FIG. 1, at least one pair of connectors 6 (there is one pair of connectors 6 in the present embodiment), as positive pin and negative pin, respectively, are molded in a non-conductive base 15 of a heat sink 3 made from plastic. This can be realized through, for instance, an insert-injection technology. As a result, the connector 6 and the heat sink 3 are formed as a whole, and the connectors 6 are firmly held in the non-conductive base 15. The heat sink 3 formed in such a manner has the function of a heat sink and also can be connected together with other component of the illuminating device by means of the connectors 6, without additional connecting means.

Figure 2:
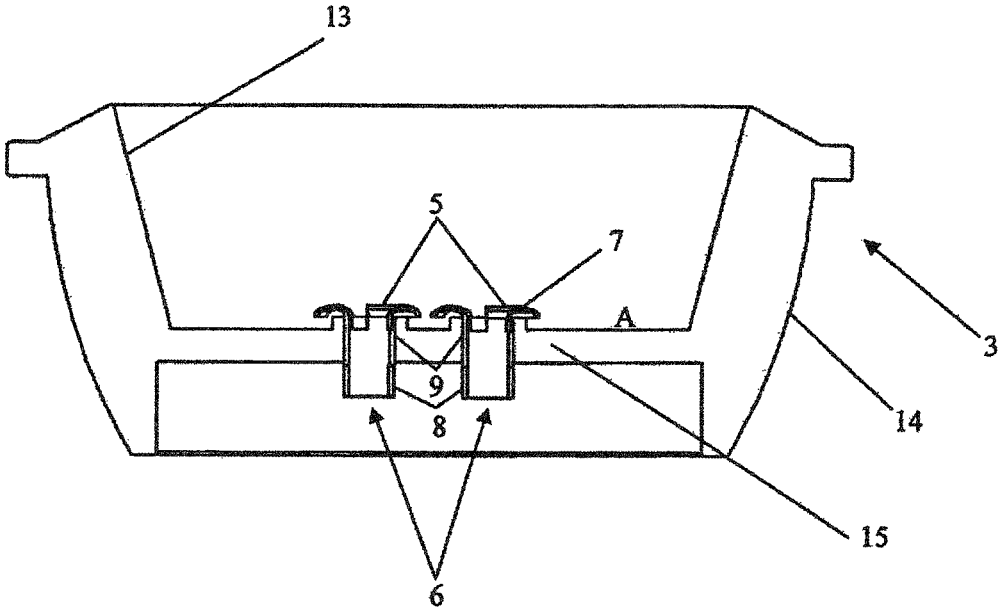
FIG. 2 is a sectional view of a heat sink of an illuminating device of the present disclosure.

It can be further seen from FIG. 1 that the connectors 6, provided in pairs, are located advantageously in a central region of the non-conductive base 15. In conjunction with the sectional view of the heat sink 3 shown in FIG. 2, it can be seen that the connectors 6 made from a conductive metal such as copper are formed in the non-conductive base 15 made from a thermal-conducting material, wherein respective connector 6 has a tubular body 9, a first end 7 located at one side of the non-conductive base 15 and a second end 8 located at the other side of the non-conductive base 15. For the sake of fixing and connecting effects, respective first end 7 is designed to bend radially outwardly from the tubular body 9 in the present disclosure. Besides, in order to prevent a short circuit caused when the tubular body 9 directly contacts an electronic device, a protective flange 5 is formed advantageously at a joint between the tubular body 9 and the first end 7. The protective flange 5 projects upwardly from an assembling surface A of the non-conductive base 15 and surrounds the tubular body 9. The first end 7 covers part of the protective flange 5 from one side in a form of, for example, turned edge. A suitable distance is kept between the first end 7 and the assembling surface A, so that the first end 7 can press against the device to be fixed when a device to be fixed is placed on the assembling surface A.

In addition, the heat sink 3 further has a non-conductive circumferential wall 13 that defines an open cavity R together with the non-conductive base 15. For obtaining better heat dissipating effects, a plurality of cooling ribs 14 are formed on an outer surface of the circumferential wall 13.

Figure 3:
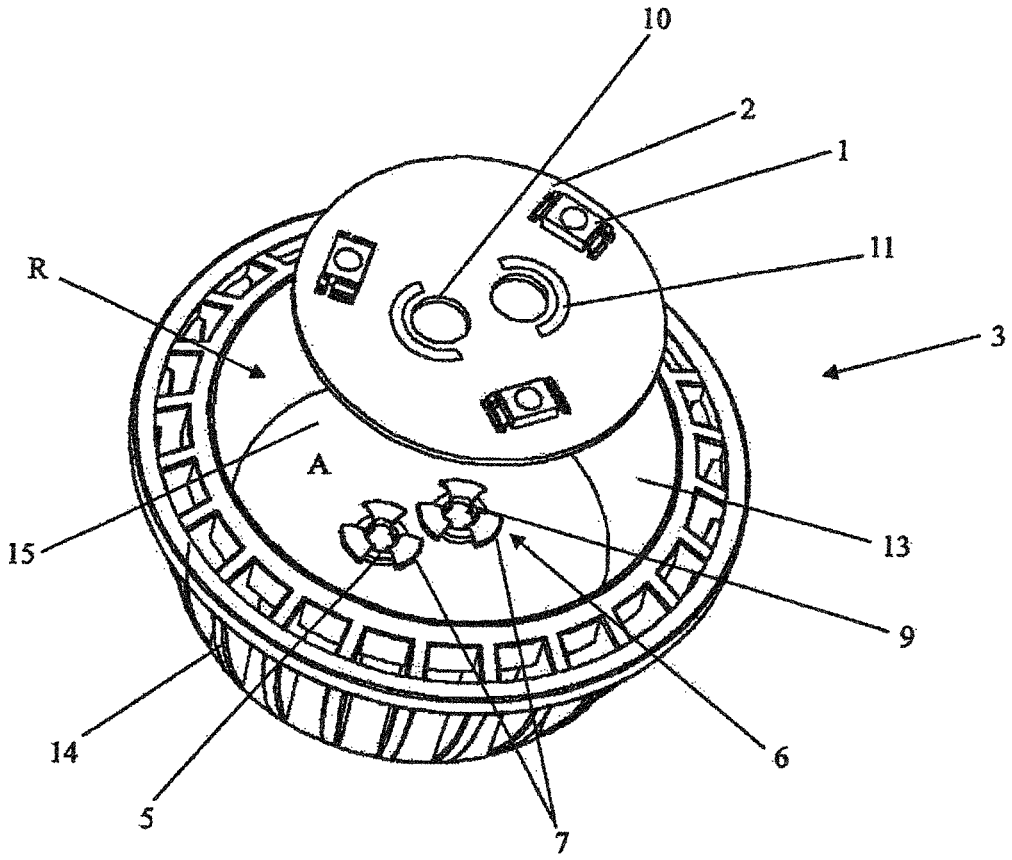
FIG. 3 is an exploded top view of an illuminating device of the present disclosure.

FIG. 3 is an exploded top view of an illuminating device of the present disclosure. Compared with FIG. 1, the difference of FIG. 3 lies in that the open cavity R of the heat sink 3 accommodates a circuit board 2 carrying a light-emitting element 1. The circuit board 2 has first via holes 10 corresponding to the first ends 7 and conduction regions 11 surrounding respective via holes 10. The first end 7 passes through the via hole 10 to press the circuit board 2 against the assembling surface A, and the first end 7 electrically contacts the conduction region 11, wherein the protective flange 5 is located between the tubular body 9 and an edge of the via hole 10, as a result, the tubular body 9 and the circuit board 2 are separated. In order to not affect the luminous efficiency of the light-emitting element 1 accommodated in the cavity R, an inner surface of the circumferential wall 13 can be designed to be a reflective surface. That is to say, the heat sink 3 preferably can be used as a reflective cup that has the heat dissipating effect in the present embodiment.

Figure 4:
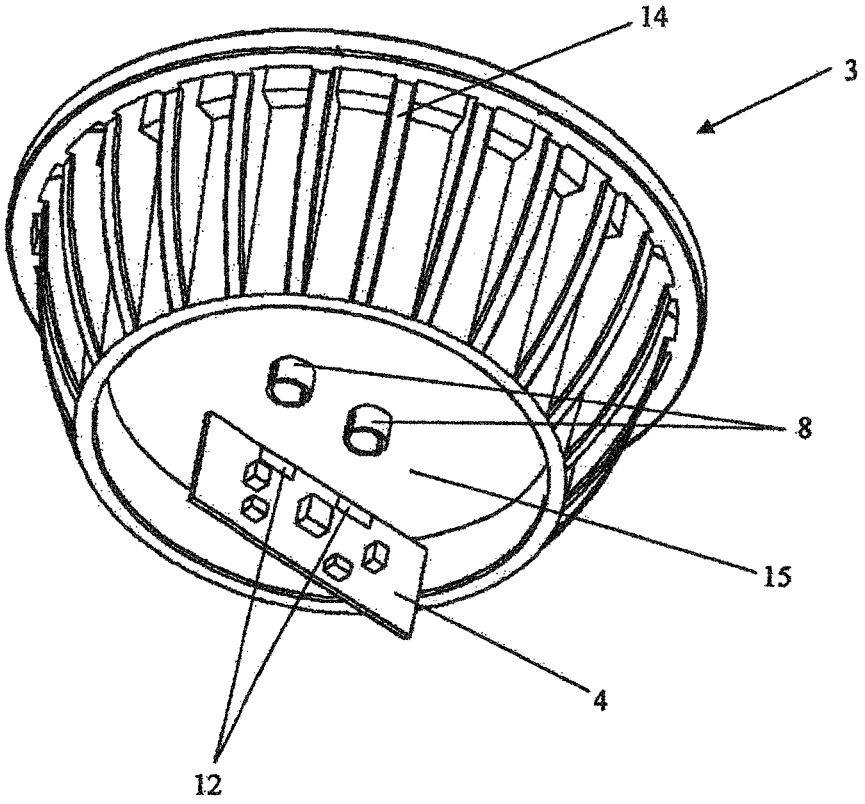
FIG. 4 is an exploded bottom view of an illuminating device of the present disclosure.

FIG. 4 is an exploded bottom view of an illuminating device of the present disclosure. The second end 8 of respective connector 6 is located at the other side of the non-conductive base 15, i.e., one side away from the assembling surface A. Correspondingly, the driver 4 at the same side comprises an accommodating portion 12 for accommodating the second end 8. The second end 8 can be inserted into or held in the accommodating portion 12; therefore, the driver 4 is fixed on the other side of the non-conductive base 15. As respective connector 6 has the first end 7 electrically connected to the circuit board 2 and the second end 8 electrically connected to the driver 4, the circuit board 2 and the driver 4, located at both sides of the non-conductive base 15, respectively, can be simply and reliably electrically connected by using the connectors 6 embedded in the non-conductive base 15.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

1 light-emitting element
2 circuit board
3 heat sink
4 driver
5 protective flange
6 connector
7 first end
8 second end
9 tubular body
10 via hole
11 conduction region
12 accommodating portion
13 circumferential wall
14 cooling rib
15 non-conductive base
A assembling surface
R cavity

The invention claimed is:

1. An illuminating device, comprising:

a circuit board carrying a light-emitting element, a driver and a heat sink arranged between the circuit board and the driver, wherein the heat sink is non-conductive and at least one pair of conductive connectors are embedded in the non-conductive heat sink, each respective connector having a first end extending from one side of the non-conductive heat sink to hold the circuit board and a second end extending from the other side of the non-conductive heat sink to hold the driver, wherein the circuit board and the driver are electrically connected by means of the connectors.

2. The illuminating device according to claim 1, wherein the connectors are formed in the non-conductive heat sink through an insert-molding process.

3. The illuminating device according to claim 2, wherein respective connector has a tubular body and at least one bending portion as the first end that bends radially outwardly from the tubular body.

4. The illuminating device according to claim 3, wherein the non-conductive heat sink further has protective flanges each formed at a joint between the tubular body and the first end and surrounding the tubular body.

5. The illuminating device according to claim 3, wherein the circuit board has via holes and conduction regions surrounding respective via holes, and the first end passes through the via hole to press against the conduction region and electrically contact the conduction region.

6. The illuminating device according to claim 3, wherein the second end of respective connector is tubular, and the driver comprises an accommodating portion for accommodating the second end.

7. The illuminating device according to claim 1, wherein the non-conductive heat sink further comprises a non-conductive circumferential wall which defines a cavity together with the non-conductive heat sink for accommodating the circuit board.

8. The illuminating device according to claim 7, wherein an inner surface of the circumferential wall is designed to be a reflective surface.

9. The illuminating device according to claim 7, wherein a plurality of cooling ribs are formed on an outer surface of the circumferential wall.

10. The illuminating device according to claim 1, wherein the connectors are made from metal.

11. The illuminating device according to claim 1, wherein the heat sink is made from plastic.

12. A method for manufacturing an illuminating device, the method comprising:

providing at least one pair of connectors, injecting a non-conductive material around the connectors in one piece through an insert-injection technology to form a non-conductive heat sink, with a first end of respective connector extending from one side of non-conductive heat sink, and with a second end of respective connector extending from the other side of the non-conductive heat sink;

providing a circuit board for carrying a light-emitting element, holding the circuit board on the one side of the non-conductive heat sink with the first ends, and electrically connecting the first ends and the circuit board; and providing a driver, fixing the driver on the other side of the non-conductive heat sink with the second ends, and electrically connecting the second ends with the driver.

13. The method according to claim 12, wherein in said providing the at least one pair of connectors, respective connector comprises a tubular body, the first end bending radially outwardly from the tubular body and the second end that is tubular.

14. The method according to claim 13, wherein in said providing the circuit board, the circuit board has via holes corresponding to respective first ends and conduction regions surrounding respective via holes, and the first end passes through the via hole to press against the conduction region and electrically contact the conduction region.

15. The method according to claim 13, wherein in said providing the driver, the driver comprises accommodating portions for accommodating respective second ends.

* * * * *